United States Patent [19]

Chou et al.

[11] Patent Number: 4,942,863

[45] Date of Patent: Jul. 24, 1990

[54] THERMOELECTRIC GENERATOR FOR USE IN A HEATER AND METHOD OF INSTALLATION

[75] Inventors: Der-Jeou Chou, Taipei, Taiwan; John C. Young, 408 N. Cedar Bluff Rd., Suite 200, Knoxville, Tenn. 37923

[73] Assignee: John C. Young, Farragut, Tenn.

[21] Appl. No.: 334,595

[22] Filed: Apr. 6, 1989

[51] Int. Cl.[5] ..... F24H 3/02

[52] U.S. Cl. ..... 126/110 E; 126/110 B; 237/12.1; 237/81

[58] Field of Search ..... 237/12.1, 13; 126/110 B, 101, 116, 110 E; 136/200, 201, 205, 217

[56] References Cited

U.S. PATENT DOCUMENTS

| | | | |
|---|---|---|---|
| 2,362,258 | 6/1942 | Findley | 126/110 |
| 2,362,259 | 11/1944 | Findley | 171/125 |
| 2,363,168 | 11/1944 | Findley | 126/110 |
| 2,390,578 | 4/1943 | Findley | 136/4 |
| 2,519,241 | 8/1950 | Findley | 126/116 |
| 3,057,340 | 10/1962 | Fritts | 126/101 |
| 3,150,656 | 9/1964 | Huber | 126/110 |
| 3,620,205 | 11/1971 | Veal | 126/110 |
| 3,759,244 | 9/1973 | Konet | 126/110 |

*Primary Examiner*—Henry A. Bennett

*Attorney, Agent, or Firm*—Luedeka, Hodges & Neely

[57] ABSTRACT

A thermoelectric generating assembly for replacement of a heat exchanger mounted in a fuel-burning heater having electricity-consuming components includes a thermoelectric generator for supplying the electrical power requirements of the heater components and an adaptor portion for mounting the thermoelectric generator within the heater. The assembly possesses a size and shape which approximates that of the heat exchanger to be replaced and can be mounted within the heater in a manner like that in which the heat exchanger is mounted within the heater prior to removal. The method includes the steps involved in replacing the heat exchanger with the thermoelectric generating assembly.

17 Claims, 2 Drawing Sheets

THERMOELECTRIC GENERATOR FOR USE IN A HEATER AND METHOD OF INSTALLATION

BACKGROUND OF THE INVENTION

This invention relates generally to heaters and relates more particularly to fuel-burning heaters for heating fluids, such as air, with a heat exchanger.

A fuel-burning heater of the type with which this invention is concerned includes an outer shell or casing, a burner assembly for generating a flame from fuel supplied thereto, a heat exchanger mounted within the casing having an inner cavity within which the flame of the burner assembly is generated, and means for moving a heat exchange medium, such as air, between the outer surface of the heat exchanger and the inner surface of the casing. During operation of the heater, the heat exchanger is heated by the generated flame, and the heat exchange medium is heated by the heat exchanger. Such a heater is known in the art and commercially-available.

Commonly, a heater of the aforedescribed type requires electrical power for its operation. Such power, for example, may be consumed by the means for moving the heat exchange medium through the heater. Normally, the required electrical power is supplied by a battery or a power plant external of the furnace. Inasmuch as batteries require replacement and the electrical power from a power plant is not available in every application in which such a heater is desired to be used (e.g., use of a heater in remote locations), it would be desirable to provide a power source for a heater which renders the heater independent of batteries or an external power plant.

Accordingly, it is an object of the present invention to provide a power source for supplying the electrical power requirements of a fuel-burning heater which circumvents any need for electrical power from a battery or a power plant.

Another object of the present invention is to provide a thermoelectric generating assembly for supplying the electrical power requirements of the heater from the heat generated by the fuel burner assembly.

Still another object of the present invention is to provide such an assembly which is adapted to be interchanged with t he heat exchanger of a commercially-available heater supplied with a heat exchanger so that the commercially-available heater can be converted to one which is independent of electrical power from a battery or an external power plant.

Yet another object of the present invention is to provide a method of replacing the heat exchanger of a commercially-available heater with a thermoelectric generating assembly.

A further object of the present invention is to provide such an assembly which is durable in construction and effective in operation.

A still further object of the present invention is to provide a heater within which a thermoelectric generator is incorporated.

SUMMARY OF THE INVENTION

This invention resides in a thermoelectric generating assembly for replacement of a heat exchanger in a fuel-burning heater having a burner assembly for generating heat and electrically-powered means such as means for moving a heat exchange medium through the heater.

The assembly is comprised of a body including a thermoelectric generator and means for mounting the thermoelectric generator within the heater. The mounting means supports the thermoelectric generator in such a relationship to the burner assembly and to the heat exchange medium routed through the heater so that the thermoelectric generator generates electricity for supplying the electrical power requirements of the heater. Furthermore, the assembly body possesses a size and shape that approximates that of the heat exchanger to be replaced, and the mounting means is compatible with means utilized for mounting the heat exchanger within the heater so that the assembly can be mounted within the heater casing in a manner like that in which the heat exchanger is mounted within the heater casing prior to removal.

The method of the invention includes the steps involved in replacing the heat exchanger of a heater with the thermoelectric generating assembly of the invention. During the method, the heat exchanger is removed from the heater, and the assembly is positioned within the heater in the place from which the heat exchanger was removed. The assembly is then mounted within the heater in a manner in which the heat exchanger was mounted within the heater prior to removal. The thermoelectric generator is then connected to the electrically-powered means of the heater so that the electricity generated by the thermoelectric generator during heater operation provides the electrical power requirements of the heater.

DETAILED DESCRIPTION OF AN ILLUSTRATIVE EMBODIMENT

Figure 1:
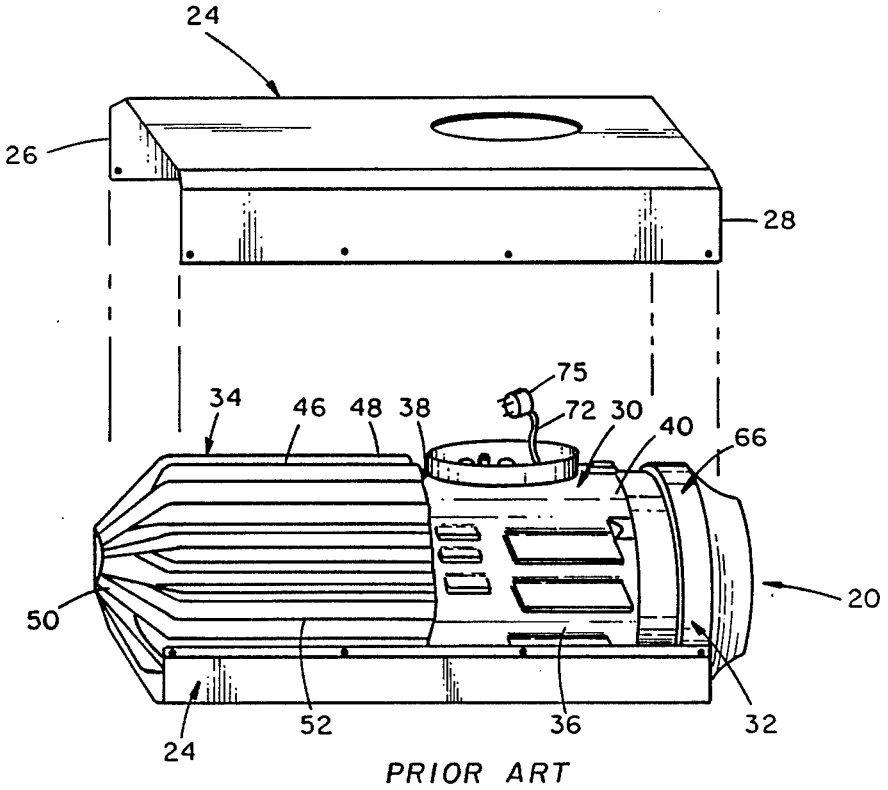
FIG. 1 is a perspective view of a commercially-available heater, shown with a portion of its casing removed.
Figure 2:
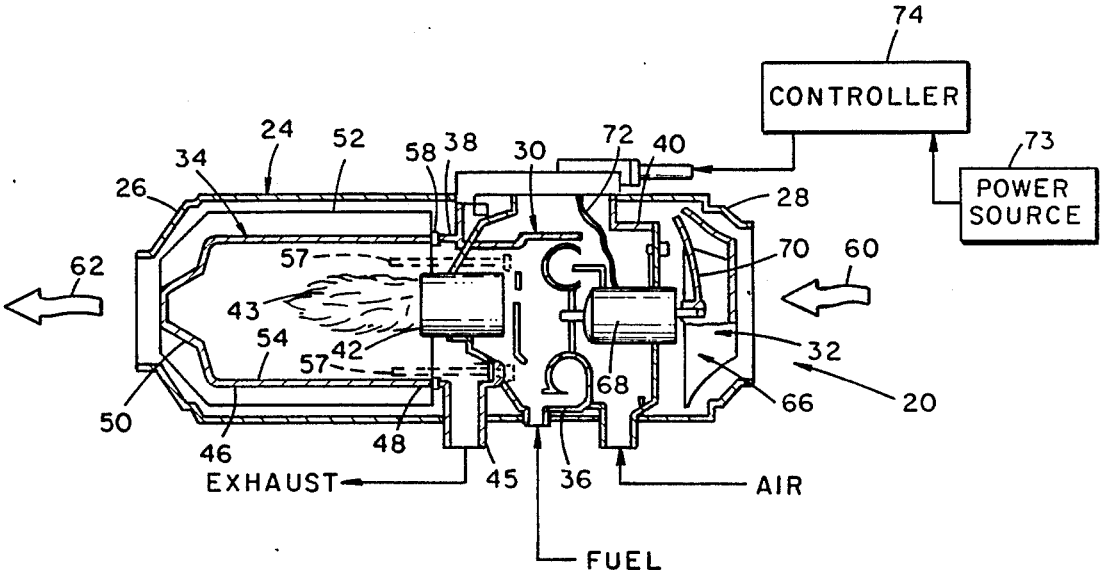
FIG. 2 is a longitudinal cross-sectional view of the FIG. 1 heater illustrating the heater operation.
Figure 3:
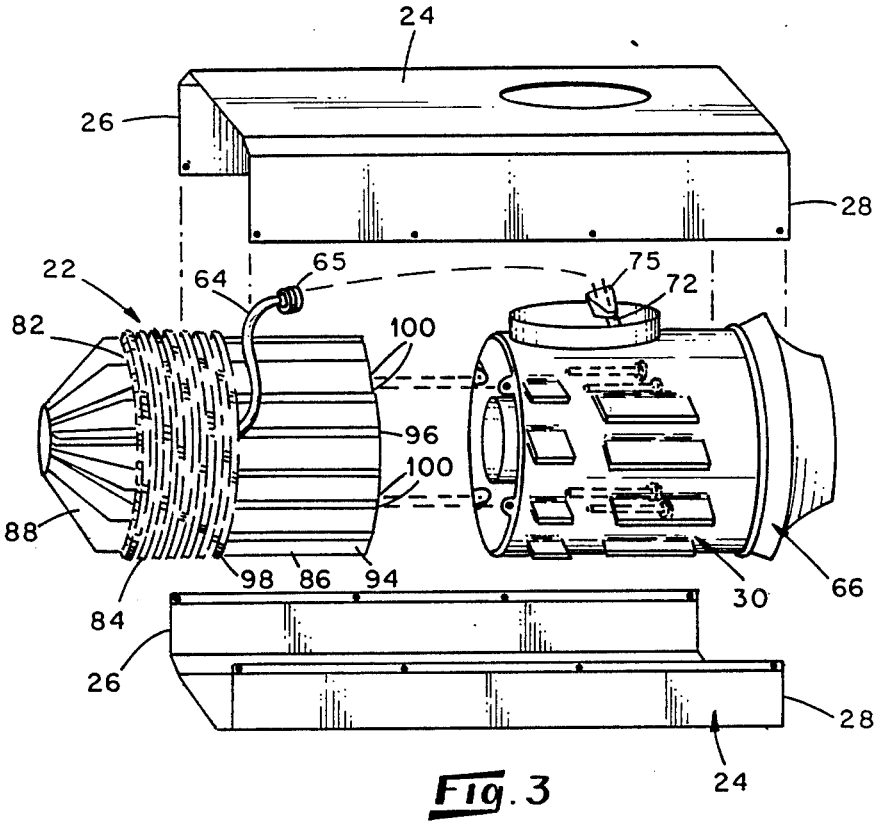
FIG. 3 is a perspective view of a heater, shown exploded, within which a thermoelectric generating assembly is incorporated.
Figure 4:
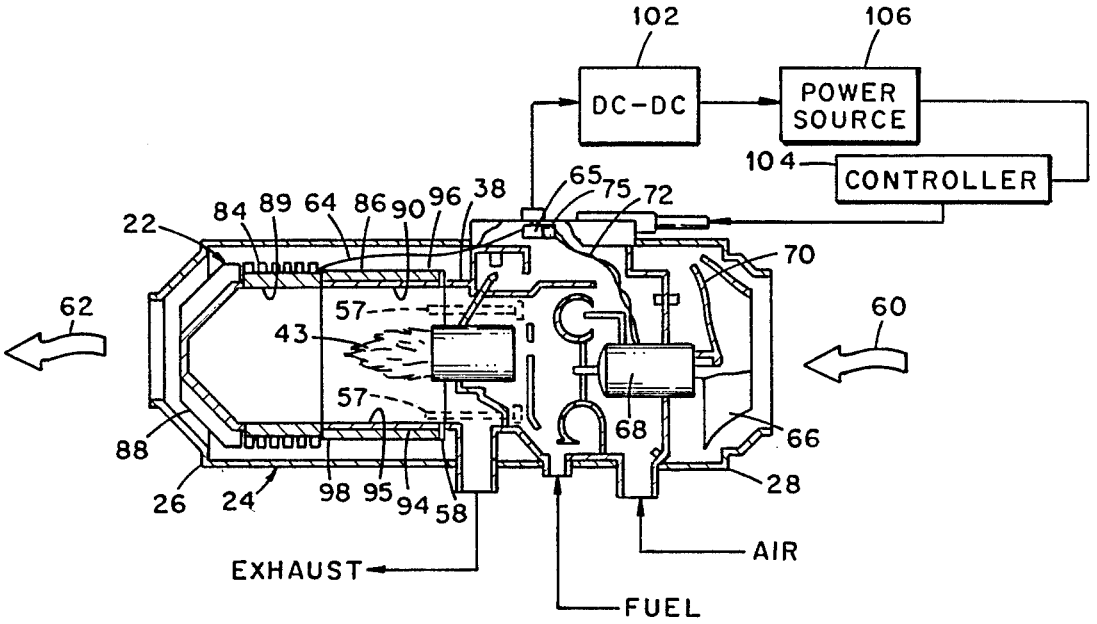
FIG. 4 is a longitudinal cross-sectional view of the FIG. 3 heater illustrating the heater operation.

Turning now to the drawings in greater detail, there is shown in FIGS. 1 and 2 a heater 20 of the type which can be retrofitted with a thermoelectric generating assembly 22, shown in FIGS. 3 and 4. The heater 20 includes an outer, substantially rectangular casing 24 having two opposite ends 26, 28, a fuel burner assembly 30 supported within the casing 24 for generating a flame therein and moving means, generally indicated 32, for moving air through the casing 24. The heater 20 also includes a heat exchanger 34 which is supplied with the heater 20 from the heater manufacturer. During operation of the heater 20, the flame generated by the burner assembly 30 heats the heat exchanger 34 which, in turn, heats air moving through the casing 24. As described herein, the thermoelectric generating assembly 22 of FIGS. 3 and 4 is adapted to replace the heat exchanger 34 of the heater 20 of FIGS. 1 and 2 so that during operation of the retrofitted heater, the thermoelectric generating assembly 22 serves the dual function of conducting heat generated by the burner assembly 30 to air moving through the heater casing 24 and generating the electrical power requirements of the heater 20.

The heater 20 illustrated in FIGS. 1 and 2 is commercially-available under the trade designation WEBASTO HL 32 from Webasto W. Baier GmbH and Co., Stockdorf, West Germany and utilizes a predetermined one of any of a number of multiple fuels, such as diesel, gasoline, kerosene, or JP8 (military grade) fuel as its fuel. In operation, the depicted Webasto heater is capable of delivering about 11,000 BTUs per hour and has been found to be well-suited for heating enclosed spaces of moderate size such as, for example, the interiors of vans, cars, trucks or buses. In addition, the depicted Webasto heater 20 includes a fan 66 described herein, which consumes electrical power during heater operation, and it is known that when operating during full load capacity, the heater 20 consumes about 32 watts. Although the heater 20 described herein is utilized for heating air, it will be understood that a heater within which a thermoelectric generating assembly can be mounted, in accordance with the broader aspects of this invention, may be utilized for heating some other heat exchange medium, such as water. Accordingly, the principles of the present invention may be variously applied.

As best shown in FIG. 2, the fuel burner assembly 30 includes a substantially cylindrical body 36 having two opposite ends 38, 40 and a combustion chamber 42 adjacent the end 40. During operation of the heater, air and fuel are routed through suitable conduits to the combustion chamber 42 where they are mixed and burned for generating a flame 43. An exhaust conduit 45 associated with the burner assembly 30 conducts the products of combustion out of the heater 20.

The heat exchanger 34 includes a body 46 having two opposite ends 48, 50 and a finned outer surface 52. The body 46 defines an interior cavity 54 which opens out of the end 48 and which extends for a substantial distance into the body 46 as best shown in FIG. 2. The heat exchanger body 46 is joined to the end 38 of the burner assembly body 36 so that the flame 43 generated within the combustion chamber 42 is directed generally into the interior cavity 54. During operation of the heater 20, the walls of the interior cavity 54 are heated by the flame 43, and the h®at absorbed by the walls of the interior cavity is conducted to the fins of the outer surface 52 where it is transferred to the air forced across the fin surfaces.

The heat exchanger 34 is affixed to the body 36 of the fuel burner assembly 30 so that the heat exchanger body 46 is maintained in a stationary relationship with the fuel burner assembly body 36. In this connection, the bodies 36, 46 define four sets of axially-extending, internally-threaded apertures for threadably receiving four bolts 57 (only two indicated in FIG. 2). Access to the heads of the bolts 57 is provided through the end 40 of the fuel burner assembly body 36, upon removal of the fan 66 described herein. Each aperture in a set is aligned with the other aperture in the set for threadably receiving one of the bolts 57. When tightened within the apertures, the fuel burner assembly body 36 is tightly held between the heads of the bolts and the end 48 of the heat exchanger body 46. To enhance the sealing relationship between the bodies 36 and 46, a suitable gasket 58, best shown in FIG. 2, is operatively positioned between the end 38 of the fuel burner assembly body 36 and the end 48 of the heat exchanger body 46.

Air is moved through the heater 20 between the inside walls of the casing 24 and the outer surface of the heat exchanger body 46 by means of the moving means 32, introduced earlier. In the depicted heater 20, the moving means 32 includes an electrically-powered fan 66 for drawing cool air into the heater 20 through the casing end 28 and forcing the heated air out of the casing end 26. As indicated in FIG. 2, cool air drawn into the heater end 28 moves in the direction of the arrow 60, and heated air forced out of the heater end 28 moves in the direction of the arrow 62. The fan 66 includes an electric motor 68 mounted centrally of the burner assembly body 36 adjacent the body end 40 and impeller blades 70 appropriately connected to the motor 68 so that upon energization of the motor 68, the blades 70 are rotated relative to the burner assembly body 36. The electrical power requirements of the fan 66 are delivered thereto through suitable wires 72 from a power source 73 such as a battery or external power plant. As shown in FIG. 1, the wires 72 include a plug 75 facilitating power hook-up. If desired, a controller 74 having a thermostat (not shown) can be appropriately interconnected with the heater 20 for automatically controlling the heater operation.

The thermoelectric generating assembly 22 of FIGS. 3 and 4 is adapted to replace the heat exchanger 34 of the heater 20 of FIGS. 1 and 2 and supply the electrical power requirements of the modified heater during the heater operation. As best shown in FIGS. 3 and 4, the thermoelectric generator assembly 22 includes a body 82 comprised of a thermoelectric generator 84, an adaptor portion 86 and a cap portion 88. The thermoelectric generator 84 is sandwiched between and fixedly joined with the adaptor and cap portions 86 and 88 by means of bolts or screws. Each of the thermoelectric generator 84 and adaptor portion 86 is somewhat cylindrical or ring-like in form and has a central opening 89 or 90, respectively, which is aligned with the central opening 90 or 89. The cap portion 88 is somewhat conical in shape and has an internal, somewhat conically-shaped recess 92 which is generally aligned with the central openings 89 and 90. Collectively, the aligned openings 89, 90 and recess 92 provide a central interior cavity 95 which corresponds in size and shape to that of the interior cavity 54 of the heat exchanger 34 of FIGS. 1 and 2.

The thermoelectric generator 34 contains N and P type Lead Telluride (PbTe) for generating electricity as the inside surface of the generator 84 receives heat from a source and the outside surface of the generator 84 rejects heat to a sink in a manner which is known in the art. For present purposes, Lead Telluride is preferred over other thermoelectric generator materials such as Bismuth Telluride (BiTe) due to the capacity of Lead Telluride material to withstand high temperatures. For example, it is known that a thermoelectric generator containing Lead Telluride is capable of withstanding temperatures of about 600° C. For purposes of conducting the generated electricity from the generator 84, wires 64 appropriately extend from the generator 84 and terminate in the plug 65. As shown in FIG. 4, the outside surface of the thermoelectric generator 84 includes a plurality of radially-extending pin-like fins. It is found that the pin-like fins enhance the heat transfer from the thermoelectric generator 84 to the air flowing thereacross so that the heat output of the modified heater is not appreciably affected by the substitution of the assembly 22 for the heat exchanger 34.

The adaptor portion 86 has a body 94 including two opposite ends 96, 98 and defines a finned inner surface and a finned outer surface. For mounting the assembly 22 within the heater casing 24 in place of the heat exchanger 34, the adaptor portion body 94 includes four axially-extending, internally-threaded apertures 100 opening out of the body end 96 which correspond in size and location to the mounting apertures of the heat exchanger body 46. In this connection, the outer diameter of the end 96 of the adaptor portion body 94 is about equal to that of the heat exchanger body end 48, and the apertures 100 are positioned about the body end 96 at locations which correspond to the locations at which the mounting apertures are spaced about the heat exchanger body end 48. Therefore, when the adaptor portion body end 96 is operatively positioned adjacent the end 38 of the fuel burner assembly 30, the bolts 57 (FIG. 3) can be screwed into the apertures 100 to securely mount the adaptor portion 86, and thus the assembly 22, within the casing 24. When secured in such a manner, the interior cavity 95 of the assembly 22 is in position to receive the flame 43 (FIG. 4) generated by the burner assembly 30.

To ensure a fit of the assembly 22 within the casing 24, the overall dimensions, such as the length and outer diameter, of the assembly 22 approximate those of the heat exchanger 34. Even the bullet-shaped appearance of the assembly 22 approximates that of the heat exchanger 34 so that patterns of the air moved through the casing 24 by the fan 66 are not adversely affected by the replacement of the heat exchanger 34 by the assembly 22. Therefore, the approximate size match between the heat exchanger body 34 and the assembly 22 and the compatibility of the means by which each of the heat exchanger body 34 and assembly 22 are attached to the body 36 of the fuel burner assembly 30 permits the assembly 22 to be physically positioned in the heater 20 in the place of the heat exchanger 34.

To replace the heat exchanger 34 with the thermoelectric generating assembly 22 and with reference again to FIG. 1, a portion of the casing 24 is removed from the remainder of the heater 20 and the fan 66 is removed from the casing end 28 to render the bolts 57 accessible. The bolts 57 are then removed to free the heat exchanger 34 from the fuel burner assembly 30, and the heat exchanger 34 is thereafter removed from the remainder of the heater 20. The thermoelectric generating assembly 22 is then positioned in place of the heat exchanger 34 and affixed to the fuel burner assembly 30 with the bolts 57 in the manner in which the heat exchanger 34 was affixed to the fuel burner assembly 30 prior to removal. In the depicted embodiment, the electrical wires 64 extending from the thermoelectric generator 84 are then connected to an appropriate DC-DC converter 102 which is, in turn, connected to a controller 104 by way of a power source, such as a rechargeable battery 106. It will be understood, however, that the generated power need not be routed through a battery, but it is preferred for control of the heater operation that the generated power be routed through an appropriate controller.

By using an appropriate DC-DC converter, the output voltage of the thermoelectric generator 84 can be regulated at about 0.2 volts above the voltage normally supplied from the power source 73 (FIG. 2) to ensure that the output of the generator 84 sufficiently supplies the power requirements of the heater. If desired, the excess output power can be used to charge the battery 106 or power small appliances.

It follows from the foregoing that the present invention accomplishes its intended purposes and objects. In this connection, a thermoelectric generator assembly 22 has been described which is adapted to replace a heat exchanger in a commercially-available heater for supplying the electrical power requirements of the heater during heater operation. The size and appearance of the thermoelectric generating assembly 22 approximate those of the heat exchanger which the assembly 22 is adapted to replace, and the means for mounting the assembly within the heater is compatible to that of the heat exchanger so that the assembly 22 can be mounted within the heater casing in a manner like that in which the heat exchanger is mounted within the heater prior to removal.

In addition, if it is desired that the modified heater be re-converted to its original condition, the thermoelectric generator can be removed from the modified heater and the heat exchanger re-mounted in its original position within the heater casing. Thus, the replacement of the heat exchanger with the thermoelectric generator assembly involves no destruction of components or parts which may otherwise prevent the return of the heater to its original, or unmodified, condition.

It will be understood that numerous modifications and substitutions can be had to the aforedescribed embodiment without departing from the spirit of the invention. For example, while the heat exchanger 34 of the aforedescribed heater 20 has been shown and described as being attached to the fuel burner assembly 30 by means of bolts 57, there exists heaters having heat exchangers which are attached to corresponding fuel burner assemblies by means of a buckle-type arrangement. For purposes of interchanging with a heat exchanger in this type of heater, the thermoelectric generator assembly includes the appropriate hardware for interconnecting with the buckle-type arrangement of the heater. Accordingly, the aforedescribed embodiments are intended for the purpose of illustration and not as limitation.

What is claimed is:

1. A thermoelectric generating assembly for use in a fuel-burning heater designed to utilize a heat exchanger of a predetermined size and shape and wherein the fuel-burning heater includes a burner assembly for generating heat and components which require electrical power for heater operation such as means for moving a heat exchange medium through the heater so that the heat exchange medium is heated by the heat generated by the burner assembly through the heat exchanger, said assembly comprising a body including:

a thermoelectric generator; and means for mounting the thermoelectric generator in such a relationship to the burner assembly and to the heat exchange medium routed through the heater so that the thermoelectric generator generates electricity for supplying at least a portion of the electrical power requirements of said heater components, said assembly body possessing a size and shape which approximates that of the heat exchanger with which the fuel-burning heater is designed to be utilized and said mounting means is compatible with means utilized for mounting the heat exchanger with which the fuel-burning heater is designed to be utilized within the heater so that said assembly can be mounted within the heater in place of the heat exchanger with which the heater is designed to be utilized.

2. The assembly as defined in claim 1 further including wiring means for operatively interconnecting the thermoelectric generator with the electrical power-consuming components of the heater.

3. The assembly as defined in claim 1 wherein the heat exchanger with which the fuel-burning heater is designed to be utilized is securable within the heater with threaded fasteners when the heat exchanger is operatively positioned within the heater and said assembly body is adapted to be secured within the heater with said threaded fasteners in the same manner in which the heat exchanger is securable within the heater when positioned therein.

4. The assembly as defined in claim 1 wherein the heat exchanger with which the heater is designed to be utilized includes a body having a internal cavity for receiving the heat generated by the burner assembly and an outer surface for rejecting heat to the heat exchange medium routed through the heater, and said assembly body includes an internal cavity which approximates the size and shape of that of the heat exchanger body and includes an outer surface of about the same size as that of the heat exchanger so that when the assembly body is operatively mounted within the heater, the internal cavity of the assembly body receives heat generated by the burner assembly and rejects heat to the heat exchange medium routed through the heater.

5. The assembly of claim 4 wherein the body of the heat exchanger with which the heater is designed to be utilized includes an outer surface which is generally bullet-shaped in appearance and is positionable within the heater so that its larger end is positioned adjacent the burner assembly, and said assembly body has an outer surface which is generally bullet-shaped in appearance and is positionable within the heater in place of the heat exchanger with which the heater is designed to be utilized so that the larger end of said assembly body is positioned adjacent the burner assembly.

6. The assembly of claim 4 wherein the thermoelectric generator of said assembly is somewhat ring-like in shape and has an inner surface which provides at least a portion of the interior cavity of said assembly body and has an outer surface which provides at least a portion of the outer surface of said assembly body.

7. The assembly of claim 6 wherein the outer surface of the thermoelectric generator provides only a portion of the outer surface of said assembly body and the remainder of the outer surface of said assembly body defines a plurality of fins for enhancing the heat transfer from the outer surface of said assembly body to the heat exchange medium routed through the heater.

8. The assembly of claim 1 wherein the material of the thermoelectric generator for generating electricity in the presence of a temperature differential is N type and P type Lead Telluride.

9. A thermoelectric generating assembly for use in a fuel-burning heater designed to utilize a heat exchanger and wherein the fuel-burning heater includes a casing, a burner assembly positioned within the casing for generating heat and electrically-powered means including means for moving a heat exchange medium through the casing and wherein the heat exchanger with which the fuel-burning heater is designed to be utilized is adapted to be mounted in a prescribed position within the casing by heat exchanger mounting means so that the heat exchanger is heated by the heat generated by the burner assembly and rejects heat to the heat exchanger medium moving through the casing, said thermoelectric generating assembly comprising a body including:

a thermoelectric generator having first and second sides and adapted to generate electricity when said first side receives heat from a heat source and said second side rejects heat to a head sink; and means for mounting said thermoelectric generator within said heater in the prescribed position where the heat exchanger with which the heater is designed to be utilized is adapted to be mounted so that said first side of said thermoelectric generator receives heat generated by the burner assembly and said second side rejects heat to the heat exchange medium moving through the casing so that electricity is generated by the thermoelectric generator for supplying at least a portion of the electrical power requirements for the electrically-powered means of the heater;

said mounting means including a portion of like construction to that of the heat exchanger mounting means so that said assembly can be mounted within the heater casing in a manner like that in which the heat exchanger with which the heater is adapted to be utilized is adapted to be mounted within the heater casing.

10. The assembly as defined in claim 9 further including wiring means for operatively interconnecting the thermoelectric generator with the electrically-powered means of the heater.

11. The assembly as defined in claim 9 wherein the heat exchanger with which the fuel-burning heater is designed to be utilized is securable within the heater with threaded fasteners when the heat exchanger is operatively positioned within the heater and said assembly body is adapted to be secured within the heater with said threaded fasteners in the same manner in which the heat exchanger is secured within the heater when positioned therein.

12. The assembly as defined in claim 9 wherein the heat exchanger with which the heater is designed to be utilized includes a body having an internal cavity for receiving the heat generated by the burner assembly and an outer surface for rejecting heat to the heat exchange medium routed through the casing, and said assembly body includes an internal cavity which approximates the size and shape of that of the heat exchanger and includes an outer surface of about the same size as that of the heat exchanger body so that when the assembly body is operatively mounted within the heater, the internal cavity of the assembly body receives heat generated by the burner assembly and rejects heat to the heat exchange medium routed through the heater.

13. The assembly of claim 12 wherein the body of the heat exchanger with which the heater is designed to be utilized includes an outer surface which is generally bullet-shaped in appearance and is positionable within the heater so that its larger end is positioned adjacent the burner assembly, and said assembly body has an outer surface which is generally bullet-shaped in appearance and is positionable within the heater in place of the heat exchanger with which the heater is designed to be utilized so that its larger end is positioned adjacent the burner assembly.

14. The assembly of claim 12 wherein the thermoelectric generator of said assembly is somewhat ring-like in shape and has an inner surface which provides at least a portion of the interior cavity of said assembly body and has an outer surface which provides at least a portion of the outer surface of said assembly body.

15. The assembly of claim 14 wherein the outer surface of the thermoelectric generator provides only a portion of the outer surface of said assembly body and the remainder of the outer surface of said assembly body defines a plurality of fins for enhancing the heat transfer from the outer surface of said assembly body to the heat exchange medium routed through the casing.

16. The assembly of claim 9 wherein the material of the thermoelectric generator for generating electricity in the presence of a temperature differential is N type and P type Lead Telluride.

17. A method for replacing a heat exchanger with a thermoelectric generating assembly wherein the heat exchanger is mounted within a fuel-burning heater having a burner assembly for generating heat and at least one component which requires electrical power for heater operation such as means for moving a heat exchange medium through the heater so that the heat exchange medium is heated by the heat generated by the burner assembly through the heat exchanger, said method comprising the steps of:

providing a thermoelectric generating assembly comprising a body including a thermoelectric generator and means for mounting the thermoelectric generator in such a relationship to the burner assembly and the heat exchange medium routed through the heater so that the thermoelectric generator generates electricity, said assembly body possessing a size and shape which approximates that of the heat exchanger to be replaced and said mounting means are compatible with means utilized for mounting the heat exchanger within the heater so that upon removing the heat exchanger from the heater, said assembly can be mounted within the heater in a manner like that in which the heat exchanger is mounted within the heater prior to removal;

removing the heat exchanger from the heater;

positioning the thermoelectric generator assembly within the heater in the place from which the heat exchanger was removed and mounting said assembly within the heater in a manner in which the heat exchanger was mounted within the heater prior to removal; and operatively connecting the thermoelectric generator to the electrical power-consuming component of the heater so that the electricity generated by the thermoelectric generator during heater operation provides at least a portion of the electrical power requirements of said component.

* * * * *